US006606770B1

(12) United States Patent
Badrenas Buscart

(10) Patent No.: US 6,606,770 B1
(45) Date of Patent: Aug. 19, 2003

(54) SAFETY BUCKLE FOR CHILD SEATS AND THE LIKE

(76) Inventor: Jordi Badrenas Buscart, Carretera de Ribas, Km. 31, 7, E-08520 Les Franqueses del Valles (ES)

( * ) Notice: Subject to any disclaimer, the term of this patent is extended or adjusted under 35 U.S.C. 154(b) by 0 days.

(21) Appl. No.: 10/049,160

(22) PCT Filed: Aug. 4, 2000

(86) PCT No.: PCT/ES00/00307

§ 371 (c)(1),
(2), (4) Date: Jun. 24, 2002

(87) PCT Pub. No.: WO01/10259

PCT Pub. Date: Feb. 15, 2001

(30) Foreign Application Priority Data

Aug. 10, 1999 (ES) ..... 9901838

(51) Int. Cl.[7] ..... A44B 11/25
(52) U.S. Cl. ..... 24/625; 24/632
(58) Field of Search ..... 24/164, 633, 642, 24/614, 615, 182, 632; 297/464, 483, 467

(56) References Cited

U.S. PATENT DOCUMENTS 5,220,713 A * 6/1993 Lane, Jr. et al. ..... 24/628
5,406,681 A * 4/1995 Olson ..... 24/650
5,588,189 A * 12/1996 Gorman et al. ..... 24/632
5,606,783 A * 3/1997 Gillis et al. ..... 24/632
5,813,097 A * 9/1998 Woellert et al. ..... 24/631
5,908,223 A * 6/1999 Miller ..... 297/484
5,996,192 A * 12/1999 Haines et al. ..... 24/625

FOREIGN PATENT DOCUMENTS

| | | |
|---|---|---|
| DE | 2504263 A1 | 8/1976 |
| EP | 608564 A1 | 8/1994 |
| EP | 867131 A1 | 9/1998 |
| ES | 2087528 T3 | 7/1996 |

* cited by examiner

*Primary Examiner*—Robert J. Sandy

(57) ABSTRACT

Comprising, as is conventional, a base (1) and two headers (4) and (5) which couple by matching and insert in the housing defined in base (1), the buckle of the invention is mainly characterised in that button (12), which is mounted on body (1) and by means of which headers (6) and (7) are locked and released, incorporates two retaining teeth (16) and (17), considerably separated from each other, one placed frontally and the other laterally, which act on respective ledges (18) and (19) of sector (4), which they reach by means of the lateral displacement of said button (12) against the action of a spring (14), when sectors (4) and (5) of the headers are inserted in base (1), and which are released by a manual transverse operation of button (12).

23 Claims, 2 Drawing Sheets

SAFETY BUCKLE FOR CHILD SEATS AND THE LIKE

OBJECT OF THE INVENTION

The present invention relates to a buckle for seatbelts normally used for child seats and the like, particularly for chairs which attach to car seats, where safety regulations require such seatbelts to have three straps which are suitably attached to the seat and meet at a common point passing through a buckle, which is also common to the three straps.

The object of the invention is to obtain a buckle of the aforementioned type which is structurally simple and has an ideal safety performance, so that the mutual attachment between the three parts of which it consists takes place in two points which are considerably separated from each other, as well as defining both a front anchoring point and a side anchoring point.

BACKGROUND OF THE INVENTION

Safety buckles of the aforementioned type generally comprise a single-piece base provided on one of its ends with a groove or ring for attaching one of the straps which form the safety belt, and in addition defining a housing for a pair of headers which are in turn provided with corresponding rings for the other two straps, which rings are also provided with sectors which attach to each other by a male-female coupling system and which are jointly inserted in the housing of the base, and which base is provided with means for retaining or locking the former and which are released by pressing a button.

In general, means for locking the two headers within the base comprise an elastically deformable tab which ends in a saw-tooth shape which in turn acts on one of the housings, so that the locking means are secured by a simple insertion of the headers in the base, while unlocking takes place by operating a button.

These buckles are further similar in that they comprise a single locking tooth which acts on one point of one of the headers, and most are also similar in that the button acts against the elastic deformation of the locking tab, resulting in a problem which entails two aspects: the locking is not as secure as would be ideal; and the lifetime of the buckle is limited by the risk of the deformable locking tab breaking, due to crystallisation or whichever reason.

DESCRIPTION OF THE INVENTION

The safety buckle disclosed by the invention solves the aforementioned problems in a fully satisfactory manner.

For this purpose, more specifically and according to a basic structure of a conventional safety lock which comprises a base provided with a housing for coupling of the corresponding sector of two complementary headers, which header sectors housed in the base interlock by means of a matching system, said buckle is characterised by a special configuration of the locking/release button which together with a complementary configuration of the headers allows attachment of these headers, as mentioned before, to take place in two points which are significantly separated from the buckle, with the ensuing safety, and with the button moving against a spring with a useful lifetime which for practical purposes is indefinite.

More specifically, said button can move transversely also against the spring, and through guides made for such purpose in the base, and is further provided with two locking teeth, one lateral and one frontal and, in addition, in its matching coupling sector, whose width is practically identical to the base housing, incorporates a guide in the form of a bent groove for coupling the frontal tooth and a side notch is for coupling the also lateral tooth of the button, and in addition said guide and notch have inclined access ramps to the final locking position of the teeth, causing an automatic transverse displacement of the button in the coupling operation of the headers and the base, acting against the opposition of the aforementioned lateral spring by simple frontal pressure of the headers against the base.

Additionally, and as is conventional, the buckle further incorporates a second spring here placed axially on the base for the obvious purpose of pushing both headers out when they are released by a lateral pressure on the button.

DESCRIPTION OF THE DRAWINGS

The characteristics and advantages of the invention will be better understood in view of the accompanying drawings of a preferred embodiment, where for purposes of illustration only the following is shown.

PREFERRED EMBODIMENT OF THE INVENTION

Figure 1:
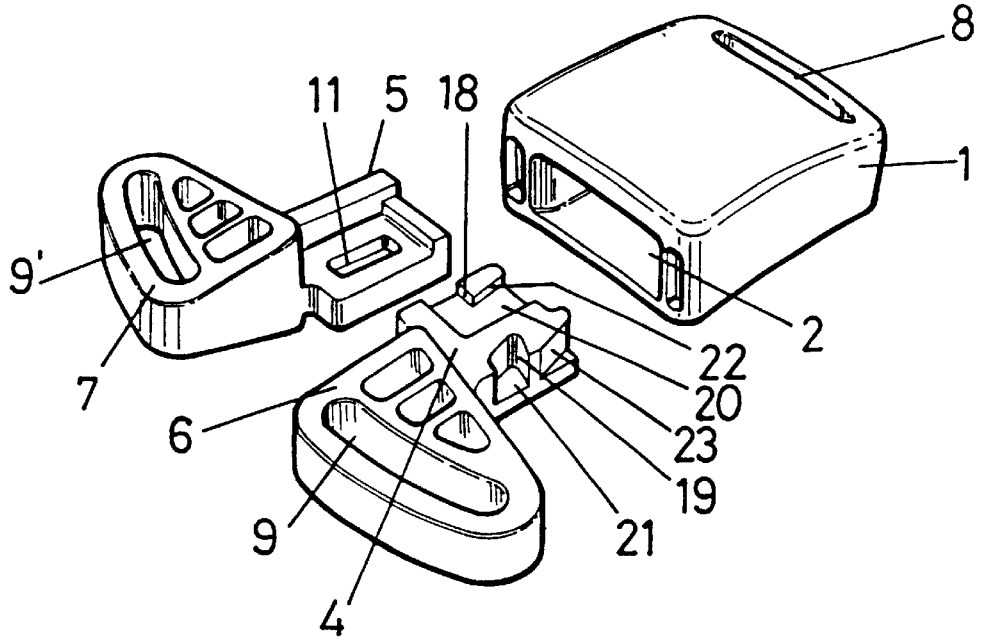
FIG. 1. Shows a perspective exploded view of a safety buckle for child seats and the like in accordance with the object of the present invention.
Figure 2:
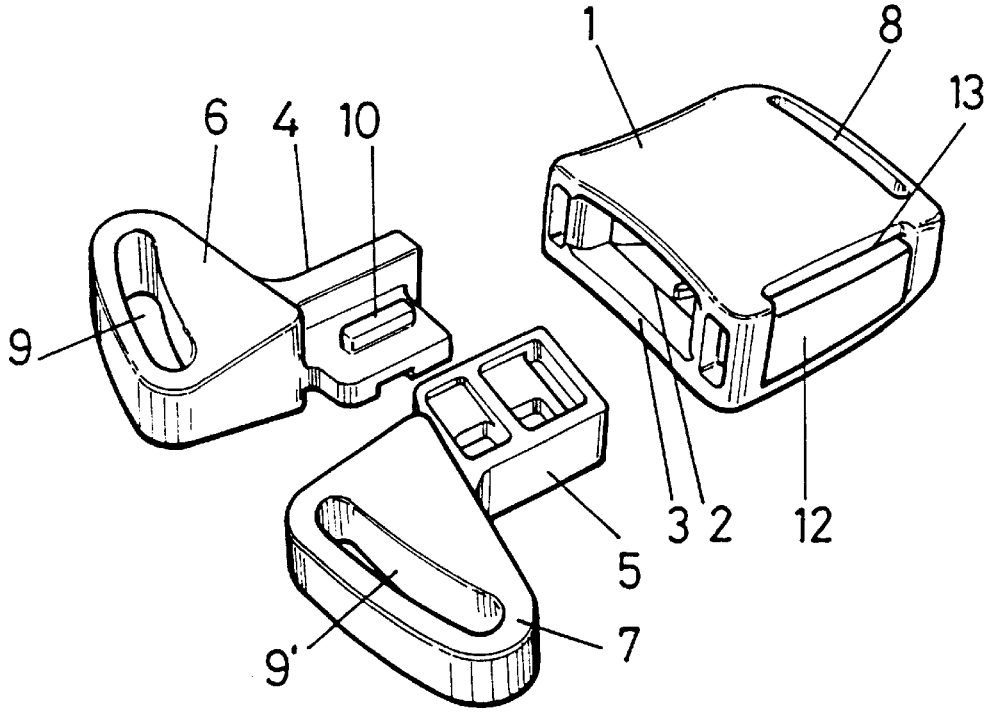
FIG. 2. Shows a further perspective view of the set shown in FIG. 1 from the opposite side of its component elements.

In view of these figures, it can be seen how the safety buckle of the invention comprises the conventional hollow base (1), in which is defined a housing (2) which is open towards the outside through an opening (3) in which insert sectors (4) and (5), which couple to each other with a matching system, and which belong to respective headers (6) and (7), with base (1) provided in its opposite closed end, opposite opening (3), with a transverse groove (8) which forms a sort of ring for anchoring the corresponding strap, while headers (6) and (7) are in turn provided with similar grooves (9–9') for attaching the other two seatbelt straps which must meet at the buckle.

Figure 4:
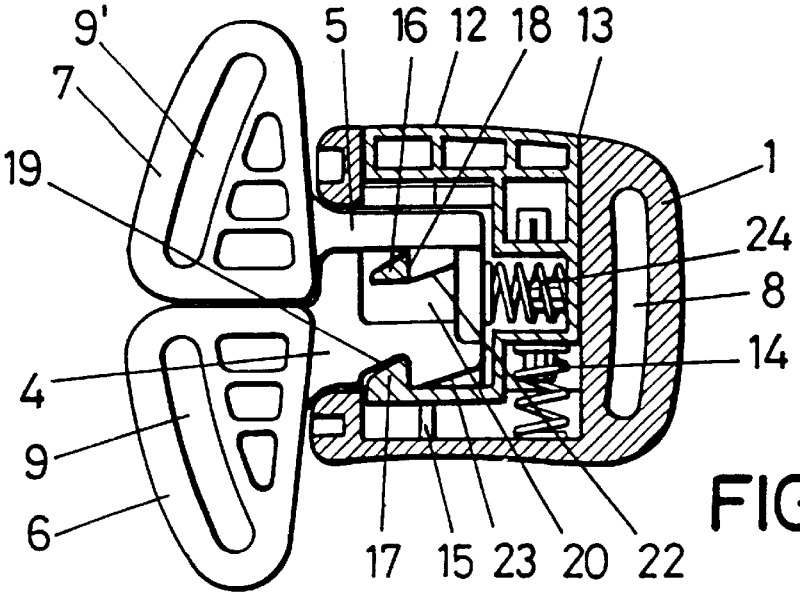
FIG. 4. Shows a plan view of the ensemble shown in FIG. 1, duly assembled and with the base sectioned in order to show clearly the inner structure and particularly the coupling of the headers to the button.
Figure 5:
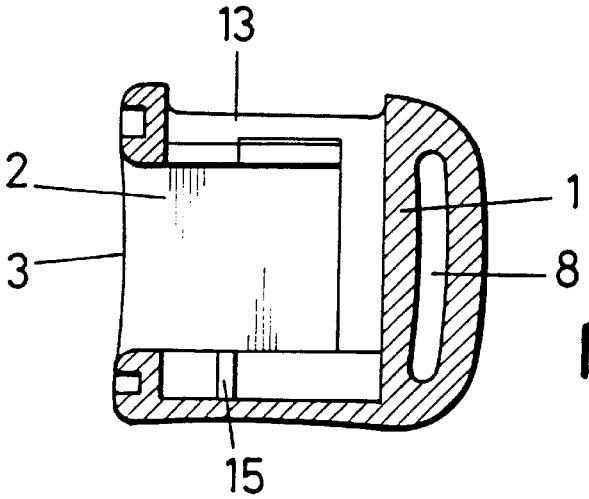
FIG. 5. Shows, finally, a plan sectional view of an enlargement of the base revealing the transverse guide means for the button.

One of the headers (6), in its sector (4) in which couples second header (7), incorporates a sturdy lug (10) which defines the means for coupling the other header (9) to sector (5), specifically in a housing (11) of the former, so that the suitable superposition of said sectors (4) and (5) forms a rectangular prismatic body which inserts in housing (2) of base (1) through opening (3), where it is impossible to separate sectors (4) and In order to attach said rectangular prismatic block (4–5) inside housing (2) of base (1), the latter is provided with a button (12) which can be directly accessed through a side opening (13) of the base and can be operated against the opposition of a spring (14) provided opposite opening (13), between button (12) and the corresponding side wall of base (1), as is clearly shown in FIG. 4, with button (12) suitably guided along its transverse motion by opening (13) on one of its ends and by a guide formed by a wall (15) of base (1) in its opposite end, which moves within a groove (15') of button (12).

Figure 3:
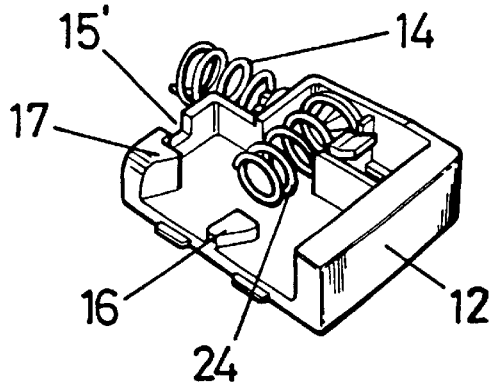
FIG. 3. Shows a perspective view of a detail of the button part of the base of the buckle of the previous figures.

In order to attain the locking of headers (6) and (7), button (12) which is mainly hollow and open on one of its bases, as shown in FIG. 3, incorporates in its bottom and on its inner face a frontal tooth (16) which is complemented by another lateral tooth (17), so that these teeth are meant to act respectively on corresponding ledges (18) and (19) operatively provided in inserting sector (4) of one of headers (6), specifically ledge (18) being the end sector o a guide (20) or bent groove of sector (4) for access of tooth (16) and ledge (19) defined by a lateral notch (21) of said sector (4), as seen particularly in FIG. 1.

Both ledge (18) and ledge (19) are accessed through inclined planes (22) and (23), so that in coupling of headers (6) and (7) to base (1) said inclined planes touch corresponding teeth (16) and (17), forcing button (12) to move transversely against spring (14) until reaching the extreme locking position in which the two teeth surpass said inclined planes and reach locking ledges (18) and (19). This manoeuvre takes place against the action of a second spring (24) which is placed axially on the button (12), so that when button (12) is later pressed in order to release teeth (16) and (17) from ledges (18) and (19), headers (6) and (7) are automatically pushed outwards.

What is claimed is:

1. A safety buckle assembly for a child seats said assembly comprising a housing having a cavity therein;

a release button positioned in said cavity and moveable therein, said release button having two retaining elements spaced from each other, and a pair of complementary tongue members connectable together to define a prismatic block which is receivable in the cavity of said housing and latchable to said retaining elements of said release button at a top face and a side face of said block respectively.

2. The assembly as claimed in claim 1, wherein the retaining elements include a first tooth and a second tooth which respectively engage first and second ledges formed on said block;

said assembly further comprising a spring against the action of which said release button is forced to move transversely, whether by manual operation of the button or by incidence of said teeth respectively on first and second inclined planes provided in the block wherein the first plane is in a groove for accessing the first ledge and the second plane is in the side face of said block for accessing a notch in which the second ledge is provided.

3. The assembly as claimed in claim 1, wherein the release button fits tightly in a lateral opening of said housing, said opening acting as a first guide for a motion of said button in said cavity;

said button has a groove and said housing has a matching internal a partition received in said groove, said partition acting as a second guide for said button in said motion.

4. The assembly as claimed in claim 1, wherein said front face and side face are angled with respect to each other.

5. The assembly as claimed in claim 4, wherein said block further has a front face which will first enter the cavity when said block is inserted into said cavity, said front face being angled with respect to both said top face and said side face.

6. The assembly as claimed in claim 1, wherein an entirety of said button is slidable with respect to said housing.

7. The assembly as claimed in claim 1, wherein said button is slidable with respect to said housing in a direction transverse to an insertion direction in which said block is inserted into said cavity.

8. The assembly as claimed in claim 1, further comprising separate first and second springs, wherein the first spring is positioned to act against insertion of said block into said cavity and to push said block out of said cavity when said release button is actuated to release said block, and the second spring is positioned to act against a motion of said button in said cavity and bias said button toward a locking position in which said block is latched to said retaining elements of said button.

9. The assembly as claimed in claim 8, wherein said springs are positioned to act in substantially perpendicular directions.

10. The assembly as claimed in claim 2, wherein said first and second ledges, said first and second inclined planes, said groove and said notch are all formed in one of said tongue members.

11. A safety buckle assembly, comprising:

a buckle comprising a housing defining a cavity and a latch member positioned in said cavity and moveable therein, said latch member having first and second retaining elements spaced from each other; and at least one tongue member which is receivable in the cavity of said housing and latchable to both said retaining elements of said latch member;

wherein said latch member is slidable in said cavity in a transverse direction which is transverse to an insertion direction in which said tongue member is inserted into said cavity.

12. The assembly of claim 11, wherein said retaining elements are spaced from each other in said transverse direction, whereby a motion of said latch member in said transverse direction unlatches said tongue member from said retaining elements of said latch member.

13. The assembly of claim 11, wherein said tongue member has a top face extending generally parallel to both said insertion and transverse directions, said top face having a generally L-shaped groove having a first section extending generally in the insertion direction and a second section extending generally in the transverse direction, a wall of said second section engages said first retaining member when said tongue member is fully inserted into said cavity, thereby preventing removal of said tongue member from said cavity.

14. The assembly of claim 13, wherein a width of said first section is sufficient to allow said first retaining member to pass through.

15. The assembly of claim 11, wherein said tongue member has, on a side extending generally in said insertion direction, a notch extending generally in said transverse direction, said notch is sized to receive therein at least part of the second retaining member and has a wall that engages said second retaining member when said tongue member is fully inserted into said cavity.

16. The assembly of claim 14, wherein said tongue member further has, on a side extending generally in said insertion direction, a notch extending generally in said transverse direction, said notch is sized to receive therein at least part of the second retaining member and has a wall that engages said second retaining member when said tongue member is fully inserted into said cavity.

17. A buckle for use in a safety strap system, said buckle comprising a housing defining a cavity;

a release button positioned in said cavity and slidably moveable therein, said release button having at least one retaining element adapted to engage a corresponding portion of a tongue member to be inserted in the cavity of said buckle;

a first spring arranged in said cavity to act against insertion of the tongue member into said cavity and to eject the tongue member from the cavity when said release button is actuated to release said tongue member, and a second spring which is different from said first spring and arranged in said cavity to act against a sliding motion of said button in said cavity and bias said button toward a locking position in which said tongue member is latched to said retaining element of said button.

18. The buckle of claim 17, wherein the first spring is carried by said button.

19. The buckle of claim 17, wherein the second spring is placed between an inner wall of said housing and said button.

20. The buckle of claim 17, wherein said first and second springs are coil springs oriented in substantially perpendicular directions.

21. The buckle of claim 17, wherein said button includes a bottom wall and a plurality of side walls extending upward from said bottom wall, one of said side walls has a groove and said housing has an internal partition received in said groove so as to guide said button in said sliding motion.

22. The buckle of claim 17, wherein said button includes a bottom wall and a plurality of side walls extending upward from said bottom wall, one of said side walls defining a surface for manually pushing said button inward of said cavity, said retaining member includes a tooth also extending upward from said bottom wall.

23. The buckle of claim 17, consisting of said housing, said button and said first and second springs.

* * * * *